US009339822B2

(12) United States Patent
Scherer

(10) Patent No.: US 9,339,822 B2
(45) Date of Patent: May 17, 2016

(54) ELECTROSTATIC PRECIPITATOR WITH ADAPTIVE DISCHARGE ELECTRODE

(71) Applicant: Bruce Edward Scherer, Toledo, OH (US)

(72) Inventor: Bruce Edward Scherer, Toledo, OH (US)

( * ) Notice: Subject to any disclaimer, the term of this patent is extended or adjusted under 35 U.S.C. 154(b) by 392 days.

(21) Appl. No.: 13/834,099

(22) Filed: Mar. 15, 2013

(65) Prior Publication Data

US 2014/0260988 A1 Sep. 18, 2014

(51) Int. Cl.
*B03C 3/62* (2006.01)
*B03C 3/41* (2006.01)

(52) U.S. Cl.
CPC ... *B03C 3/62* (2013.01); *B03C 3/41* (2013.01); *B03C 2201/08* (2013.01); *B03C 2201/10* (2013.01)

(58) Field of Classification Search
CPC .. B03C 2201/08; B03C 2201/10; B03C 3/41; B03C 3/62
See application file for complete search history.

(56) References Cited

U.S. PATENT DOCUMENTS 3,930,815 A * 1/1976 Masuda ..... B03C 3/40 55/341.2
4,114,810 A * 9/1978 Masuda ..... B05B 5/032 239/706
5,729,564 A 3/1998 Cullumber
7,156,902 B1 1/2007 Altman
8,328,902 B2 12/2012 Boyden et al.
2009/0220279 A1* 9/2009 Adachi ..... G03G 15/0291 399/168
2011/1922280 8/2011 Karlsson
2012/0192713 A1* 8/2012 Scherer ..... B03C 4/37 95/60
2012/0319559 A1* 12/2012 Bulson ..... H01J 9/14 313/485

FOREIGN PATENT DOCUMENTS

GB 2068659 A 8/1981
JP 2009131823 12/2007
WO 2012009189 A2 1/2012

OTHER PUBLICATIONS

Intra Panich et al., Particulate Emission Reduction from Biomass Burning in Small Combustion Systems with a Multiple Tubular Electrostatic Precipitator, Particulate Science and Technology, Nov. 2010, 547-565, vol. 28, Issue 6, Taylor & Francis, Inc., Philadelphia, USA.
Jason M. Morosko, Composite Discharge Electrode for Electrostatic Precipitator, Mar. 2007, Ohio University (thesis).

* cited by examiner

*Primary Examiner* — Christopher P Jones
(74) *Attorney, Agent, or Firm* — Jacob W Neu; Bradley Arant Boult Cummings LLP

(57) ABSTRACT

An electrostatic precipitator having an adaptive discharge electrode is disclosed. In some embodiments, the discharge electrode may be formed of a non-ohmic material that exhibits a saturation velocity above a voltage threshold. The non-ohmic material may have a semiconductor with doping impurities or ceramics. In other embodiments, the discharge electrode is formed of an ohmic material characterized by increased resistance through the discharge electrode.

20 Claims, 5 Drawing Sheets

ELECTROSTATIC PRECIPITATOR WITH ADAPTIVE DISCHARGE ELECTRODE

FIELD OF THE INVENTION

The invention relates generally to electrostatic precipitators for industrial use.

BACKGROUND ART

Electrostatic precipitators ("ESPs") are commonly deployed in industrial applications to remove solid particles from gas flows by charging the particles and causing them to precipitate out of the gas flow. ESPs are useful in industrial and power generation applications to reduce pollution by collecting filterable dust or condensable particulate present in gasses. For example, ESPs are commonly used in fossil fuel power plants, oil and petrochemical refineries, cement plants, paper mills, various incinerators, industrial boilers, metallurgical processes, and other heavy industries to remove particulates from gas streams.

While there are multiple ESP geometries, discussed in further detail below, all ESPs have two primary components: a series of collecting electrodes and a series of discharge electrodes. FIG. 1 depicts a typical prior art configuration of an ESP 10 used in power generation or major industrial applications. A number of large metallic collecting plates 15 are hung vertically and supported by at least two support members 16. The plates 15 are spaced a set distance apart, with the spacing determined by the type of gas and particulates being cleaned. Typically, the plates 15 are anywhere from 9 to 16 inches apart. The plates 15 may be quite large, in some cases having heights exceeding 30 feet. Depending on the amount of particulate to be removed, additional plates 15 may be aligned behind the first row or field of plates 15 to create additional electric fields relative to the direction of gas flow. The collecting plates 15 are electrically grounded.

Between each pair of plates 15 is at least one discharge electrode wire or assembly 20. Typically, there are multiple discharge electrode assemblies 20. Where rigid discharge electrodes are used, as in the embodiment of FIG. 1, each discharge electrode assembly 20 carries multiple discharge electrode points 30. The discharge electrode assembly 20 may be a weighted wire or pipe and spike made of metal or other highly conductive material that carries a negative charge at a voltage above that necessary to achieve corona onset. A typical ESP may have thousands of discharge electrodes. When corona onset occurs (normally about 25 kV for 9" gas passes), the gas around a discharge electrode and the particulates contained within it becomes ionized. The electrostatic field established between the discharge electrodes and collecting plates directs the negatively charged particles onto the grounded collecting plates.

FIGS. 2A, 2B, and 2C depict a typical prior art configuration for a discharge electrode assembly 20 known as a pipe-and-spike array. A metal pipe 25 passes vertically and halfway between two collecting plates 15 (as shown in FIG. 1). Each discharge electrode point 30 is a spike 31 arrayed horizontally about the pipe 25. The spike 31 has a base 33 that is welded or otherwise secured to the pipe 25. The body 34 of the spike extends out to a end or tip 32. In some ESPs, a single spike 31 is directed in the upstream and downstream direction of the gas flow, such that each spike is parallel to the collecting plates 15 surrounding it, as depicted in FIG. 2C.

In other configurations, two spikes 31 are directed upstream and two spikes 31 are directed downstream. Each pair of spikes 31 may form a "V," with each spike 31 directed slightly toward one of the two collecting plates 15. In the "V-spike" configuration, depicted in FIG. 2B as a cross-section, each spike 31 carries half the designed current capacity as compared to the single-spike configuration. Multiple sets of discharge electrode spikes 30 are spaced along the length of the metal pipe 25, such that the entire cross-sectional area of gas 40 flowing past a pipe 25 can be ionized, carry charging current, and be scrubbed of particulates 41. One set of spikes 31 is directed upstream, and the second set of spikes 31 is directed downstream. The size and angle of the spikes 31 is dependent upon the ESP's application and the gases 40 and particulates 41 composing the gas flow. For example, in an ESP for scrubbing gas 40 produced by an oil- or coal-fired boiler, the spikes 31 will be approximately 3 inches long and have a nominal diameter between ¼ inch and 3⁄16 inch. The base 33 of each spike 31 is welded to the pipe 25. The end 32 of the spike 31 is a sharpened metallic point Wire may also be used for a discharge electrode 30 in place of spikes. The wire may be round, square, twisted, barbed, or in other configurations. Round wire of 0.109"diameter is most common.

Other ESP configurations are also well-known and practiced to meet various design constraints. For example, in a vertical flow ESP, four collecting plates form a vertical, rectangular passage through which the gas flows. In this configuration the discharge electrode assembly has a single pipe dropped through the center of the vertical passage. Multiple spikes are arranged about the metal pipe at set distances. In this configuration, known as a "rod-and-star" array, the spike array for each discharge electrode is perpendicular to the gas flow. Multiple spikes may be arranged about a given point of the pipe.

As depicted in FIG. 3, during operation of a typical ESP, particulate-laden gas 40 is directed through the inlet region 11, passes between the spaced collecting plates, known as gas passes 15, and then exits through the outlet region 12. The arrows represent the direction of gas flow, and the black dots represent the flow of electrons through the circuit. The discharge electrode assembly 20 is charged to a potential difference that causes the onset of negative coronal discharge and ionization of the gas 40. The negatively charged discharge electrodes 30 and grounded collecting plates 15 produce an electrostatic field that electrostatically attracts negatively charged particles to the collecting plates 15. During ionization, the gaseous atoms passing near the discharge electrodes 30 become ionized, as electrons associated with the atoms flow freely. Accordingly, the gas 40 becomes conductive. The negative ions in the gas 40 follow the field lines of the electrostatic field and flow toward the nearest collecting plate 15. In so doing, they attach to particulates 41 carried by the gas 40, which become charged and move to the collecting plates 15 as well. As the gas 40 flows through the gas passes 15 and past additional discharge electrodes 20, particulates 41 build up on the plates 15, forming a collected layer of ash that adheres to the plates 15 and is held there by clamping forces due to electrostatic pressure. The charging current incident on the ash layer is conducted through the ash layer to the grounded collection plate 15. Periodically, a rapper raps the collecting plate 15 to loosen the collected ash layer by accelerating the plate. The separated ash layer then drops into a hopper or other collection device and is disposed of.

ESPs often exhibit sparking in the inlet field where particulate-laden gas begins flowing between the discharge and collecting electrodes. Electrostatic theory indicates that sparking occurs when small volumes of relatively clean gas is interposed between a discharge electrode and a collecting electrode. The resulting lack of particulates significantly reduces the space charge effect in this interelectrode space, which otherwise would be a relatively stable concentration of negatively charged particulate entrained in the area between the electrodes. This increases the magnitude of the electrostatic field at the surface of the collecting plate, which leads to a significant local increase in the intensity of the current discharge from the discharge electrode, which promotes spark initiation. Sparking collapses the electrostatic potential applied to the subject precipitator field, resulting in a temporary decrease of gas ionization and particle charging until the spark is quenched and the power supply is again brought up to voltage. This in turn significantly reduces the efficiency of the ESP.

While it is customary to use highly conductive metals to produce the make the and spikes of a discharge electrode assembly, metals are unable to resist the increased flow of current resulting from the increased gradient and strength of the electrostatic field that results in arcing. Most metals and metal alloys have a resistivity between 1-100 $10^{-8}$ ohm-meters, with very low dependence on temperature.

In addition to sparking caused by the non-uniform current density that results from varying space charge effects, warped collection plates result in a locally reduced distance between the discharge electrode and collection plate. This greatly reduces the allowable voltage that may be impressed on a discharge electrode array or in such a field before sparking is initiated. Warped collection plates result in significantly reduced efficiency and increased sparking.

Another issue in current ESPs concerns the efficiency of ESPs in applications having gas flows with high-resistivity dust and particles. Dust and particles exhibiting a collected layer resistivity in excess of $1*10^{12}$ ohm-cm is considered highly resistive and is susceptible to both sparking and a phenomenon known as "back corona." A back corona occurs when positive ions are generated by electrical breakdown internally within the collected ash layer. These positive ions migrate back towards the negatively charged discharge electrodes and can cause gas-borne particles to become positively charged or neutralized. The result is very high current flow and power dissipation within the ESP field, without proper dust charging or collection.

What is needed, then, is an ESP having individual electrodes capable of reducing sparking by locally limiting current density to a level that is supportable by the collected ash layer without sparking, while maintaining higher overall power supply and voltage and current.

SUMMARY OF THE INVENTION

In some aspects, the invention relates to a discharge electrode for use in an electrostatic precipitator and operating at an operating voltage and having a base configured to receive electrical current, a body formed of a material comprising a non-ohmic material, and a discharge tip, where the discharge electrode has a resistance of at least 100 megohms at the operating voltage.

In other aspects, the invention relates to an electrostatic precipitator having a collecting electrode, and a discharge electrode having a body and a discharge tip, where a material forming the body comprises a non-ohmic material.

In still other aspects, the invention relates to a discharge electrode for use in an electrostatic precipitator and operating at an operating voltage, the discharge electrode having a base configured to receive electrical current, a body formed of a material comprising an ohmic material, and a discharge tip, where the discharge electrode has a resistance of at least 100 megohms at the operating voltage.

In still other aspects, the invention relates to an electrostatic precipitator having a collecting electrode, and a discharge electrode having a body formed of a material comprising a doping impurity, where the resistance of the body is determined by the concentration of a doping impurity.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

Described herein is a configuration for an adaptive discharge electrode that increases the efficiency of the ESP and reduces sparking. While the typical metals used to create a discharge electrode exhibit very low resistivity, other materials such as semiconductors have a higher resistivity, although not so high that the material is effectively an insulator. The resistivity of semiconductors is heavily dependent on the introduction of impurities into the material, a process known as doping. See Table 1 below for a listing of common metals and semiconductors and their resistivity.

| Element | Resistivity (Ω-m) |
|---|---|
| Iron | $9.7 * 10^{-8}$ |
| Copper | $1.7 * 10^{-8}$ |
| Nickel | $7 * 10^{-8}$ |
| Zinc | $5.8 * 10^{-8}$ |
| Titanium | $4 * 10^{-7}$ |
| Aluminum | $2.6 * 10^{-8}$ |
| Silicon (pure) | $1 * 10^{-3}$ |
| Germanium (pure) | $5 * 10^{-4}$ |

Figure 4A:
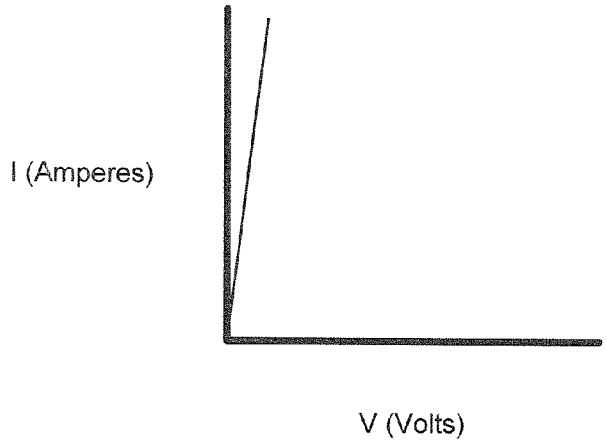
FIGS. 4A, 4B, and 4C depict voltage-current (V-I) curves for highly conductive ohmic materials, highly insulative ohmic materials, and certain non-ohmic materials, respectively.
Figure 4B:
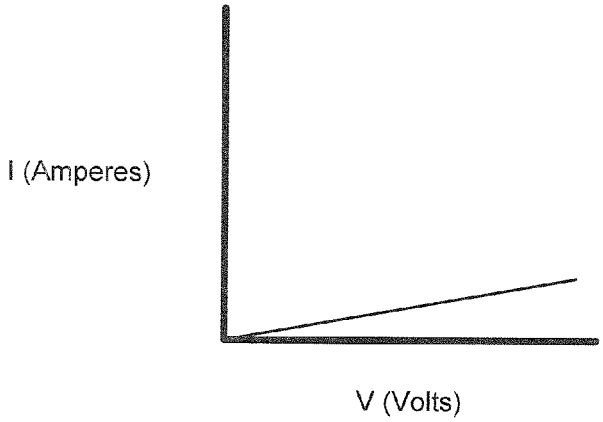
Figure 4C:
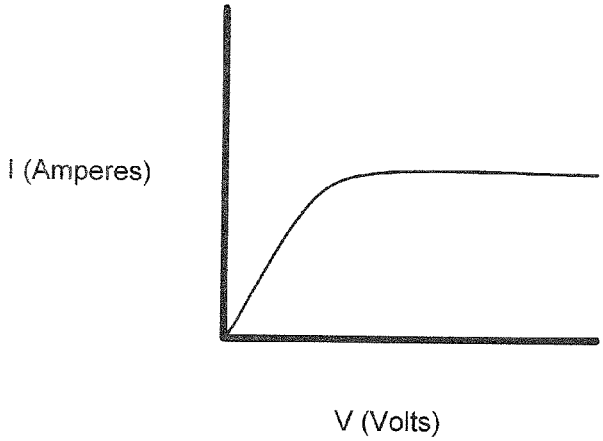

The resistivity of a particular material, electrode, or other purely resistive material at varying voltages may be depicted as a V-I curve on a graph plotting current flow versus voltage. Current, voltage, and resistance are related according to Ohm's Law:

$$V=I*R$$

where V=Voltage (the potential difference across two contact points), I=current, and R=resistance. Ohm's Law is rearranged as I=V/R to plot a V-I curve. Accordingly, the slope at any given location along the curve is equal to 1/R. Materials having low resistivity exhibit a large slope on the V-I curve, whereas materials with high resistivity have a low slope. FIGS. 4A, 4B, and 4C depict the V-I curve of various materials. Metals, such as copper, have a very high slope, as copper provides practically no resistance to current flow over the length of a discharge electrode spike. Other materials, such as silicon, have a more moderate V-I slope. Elements and metal alloys typically have linear V-I curves, indicating that such materials have a constant resistivity. Materials characterized by constant resistivity with respect to current flow and voltage are known as "ohmic" materials. FIG. 4A shows a V-I curve for a highly conductive ohmic material, such as copper. FIG. 4B shows a V-I curve for a highly insulative ohmic material, such as most elemental nonmetal solids.

Some semiconductors exhibit non-linear resistivity, particularly when doped with certain impurities such as aluminum nitride or zinc oxide or produced with defects within the crystalline structure of the semiconductor. When a sufficiently strong electrical field is applied across this type of semiconductor, the electron drift velocity through the semiconductor reaches a maximum velocity (the saturation drift velocity), a state known as velocity saturation. Once the saturation drift velocity is reached, the current through the material remains relatively constant even as the voltage applied increases. Excess voltage is dissipated through the production of vibrational phonons, which vibrate the molecular structure and result in an increased the temperature of the material. Different impurities in a semiconductor can cause saturation at varying drift velocities. In particular, aluminum nitride and zinc oxide have been found to induce velocity saturation at current and voltage densities useful in ESPs. However, other semiconductor materials and doping impurities may also be used. For the resulting V-I curve, the curve flattens out as the current reaches a the limit determined by the saturation velocity, resulting in an asymptotic curve as depicted in FIG. 4C. Materials exhibiting these non-linear curves are "non-ohmic" materials and almost always semiconductors.

Figure 5:
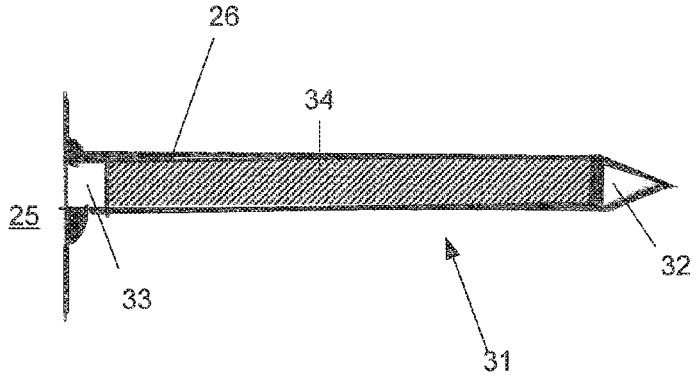
FIG. 5 is a depiction of a first embodiment of an adaptive discharge electrode according to the present disclosure.

To reduce sparking, a discharge electrode 30 may be made of ohmic materials having moderate resistivity, such as certain semiconductor materials, or alternatively made of non-ohmic materials exhibiting asymptotic V-I curves, with the potential to completely eliminate sparking. In some embodiments using a pipe-and-spike array for example, the body 34 of the spike 31 may be made from these materials. This embodiment is depicted in FIG. 5.

In an alternative embodiment, the pipe 25, spike tip 32, and spike base 33 may be made of metals or metallic alloys, whereas just the body 34 of the spike 31 is lightly doped with atoms of semiconductors or doping impurities to produce a material that exhibits a significantly higher resistivity than metal.

In any embodiment characterized by a metallic pipe 25, spike tip 32, or spike base 33, all components, except the discharge tip of the spike must be coated in an insulative material 26. The insulative coating 26 eliminates the parallel electrical path represented by surface contamination, protects the pipe 25 and spike 31 from the corrosive effects of the gas 40 being scrubbed, and directs the electric current through the spike 31.

Figure 6:
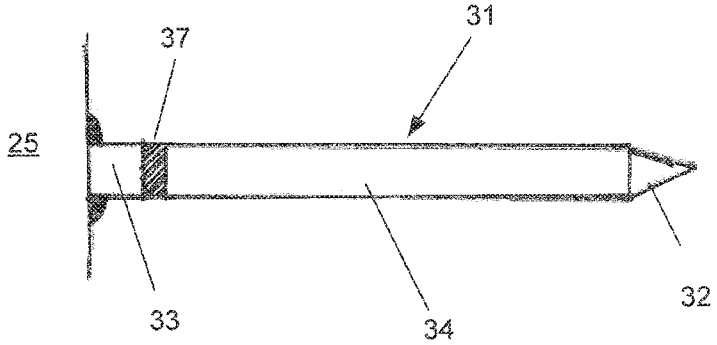
FIG. 6 is a depiction of a second embodiment of an adaptive discharge electrode according to the present disclosure.

In another embodiment, impurities used to dope semiconductors, such as zinc oxide or aluminum nitride, may be used to decrease the resistivity of a spike 31 or spike body 34 that is formed of an insulating material bonded with a metal. For example, as depicted in FIG. 6, the spike 31 may be formed of metal with a thin chip 37 of insulative material doped with zinc oxide, aluminum nitride, or some other doping impurity. For example, a chip 37 composed of zinc oxide may be only 10-20 microns thick to achieve the desired resistivity and saturation velocity. The concentration of impurities introduced into the body 34 may be proportional to the decreased resistivity across the chip 37. In typical sparking conditions, when voltage increases due to the breakdown of space charge between the discharge electrode and collecting electrode, the current that can pass through the chip 37 is limited to a maximum amperage, as described above, and inhibits sparking.

In another embodiment, the entire spike body 34 may be composed of ohmic or non-ohmic poorly conducive materials having a resistivity substantially greater than metals, such as aluminum nitride, zinc oxide, or lightly doped semiconductors or ceramics. In this embodiment, rather than inserting a chip, the doping impurities would be introduced throughout the spike body 34. The particular concentration of doping impurities would vary to achieve the desired resistivity and saturation velocity.

By fashioning a spike 31 or spike body 34 from materials exhibiting moderate or non-linear V-I curves, sparking and arcing in an ESP may be reduced or eliminated. When pockets of clean gas 40 are interposed between the discharge electrode 30 and collecting plate 15 and result in the increased electrostatic field strength, as described above, the current flow is expected to increase and result in a spark. However, by using semiconductor materials, or doping principally ceramic spikes 31 to become semiconductor materials, current flow is decreased through the spike 31 when compared to other spikes 31 in a given field, and into the gas 40. This reduces sparking activity without having to directly control the voltage impressed on all discharge electrodes in a field, and the resulting current flow into each individual discharge electrode. Instead, the inherent resistance of the discharge electrode 30 will produce a voltage drop between the metal pipe 25 and the spike tip 33 of the discharge electrode 30. The voltage drop will correspondingly decrease the current density, limiting current flow in the gas 40 flowing to the collecting plate 15. By creating this voltage drop across the discharge electrode 30, sparking is locally reduced or eliminated, depending on the resistive characteristics of the electrode and the ash layer.

Additionally, the use of the adaptive discharge electrode disclosed above can also locally limit the current density in areas where a warped collection plate results in reduced distances between the discharge electrodes and the collection plates. Warped collection plates significantly reduce the allowable impressed voltage limit before sparking occurs. Because the adaptive discharge electrode will increase resistivity when voltage increases, thereby limiting the current density, localized sparking due to warped collection plates can be reduced while the remainder of the electric field remains fully energized.

Yet another benefit is the optimization of current densities in applications involving highly resistive dust and the resulting back corona effect. During back corona, positive ions flow back from the collected dust layer towards the discharge electrode and interfere with the negative ion drift, resulting in very high current flow and low collection efficiency. By locally limiting current flows, the adaptive discharge electrode can maintain a relatively efficient level of current flow in localized areas where back corona may occur.

To achieve the necessary reduction in current to prevent or reduce sparking at an operating voltage of approximately 25 kV, the lowest measured internal resistance of the discharge electrode 30 should be at least 100 megohms (MΩ). For ESPs of various sizes and operating ranges, it is possible for the designed internal resistance, at saturation, of the discharge electrode 30 to meet or exceed 3000 MΩ.

The precise resistivity desired will depend on the particular application for which the ESP is used, and the local conditions, including the types of gases and particulates used, the operating temperature, and other factors known to those in the art. An example is provided to demonstrate how the particular resistivity for a given application may be determined.

Figure 1:
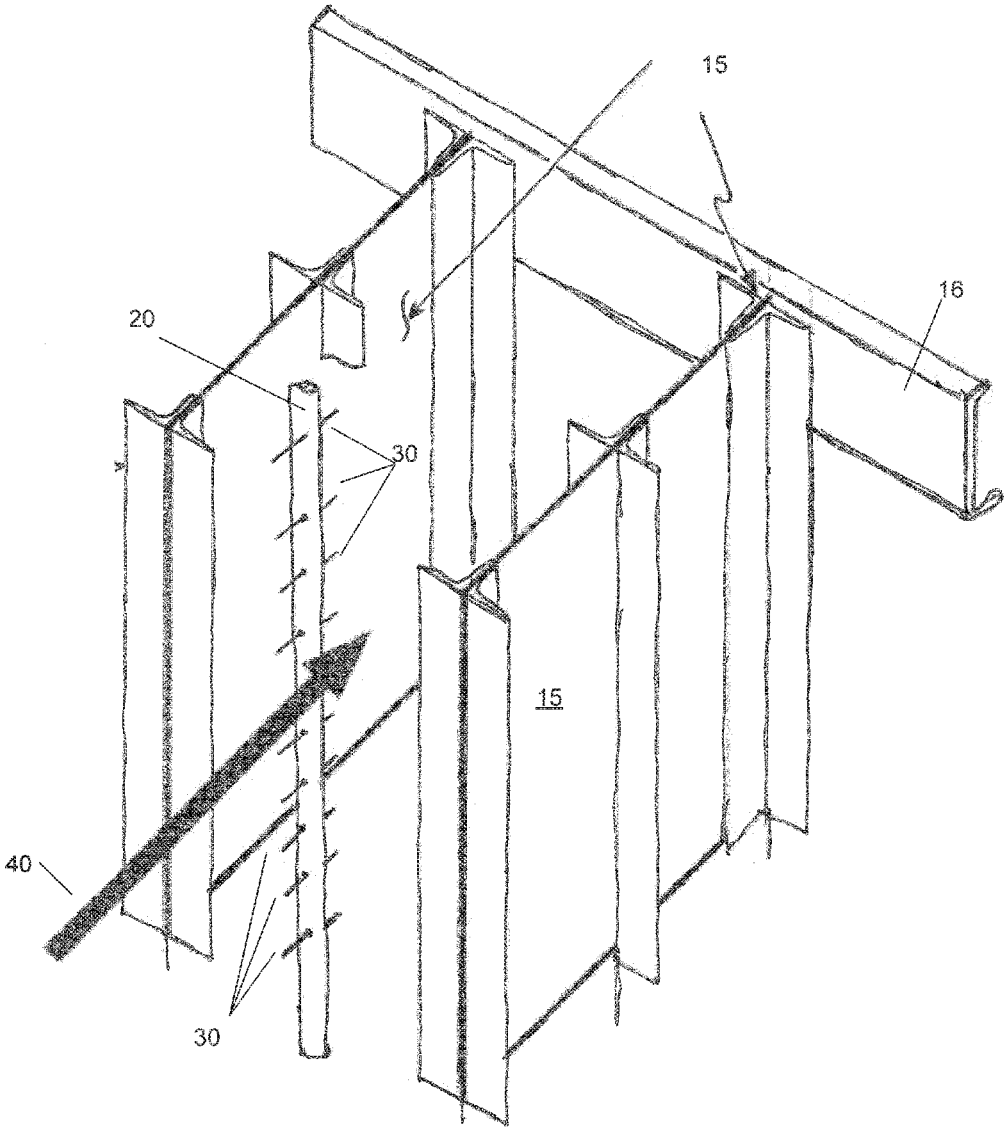
FIGURE 1 (PRIOR ART)
FIG. 1 is a prior art depiction of a typical ESP configuration.
Figure 2A:
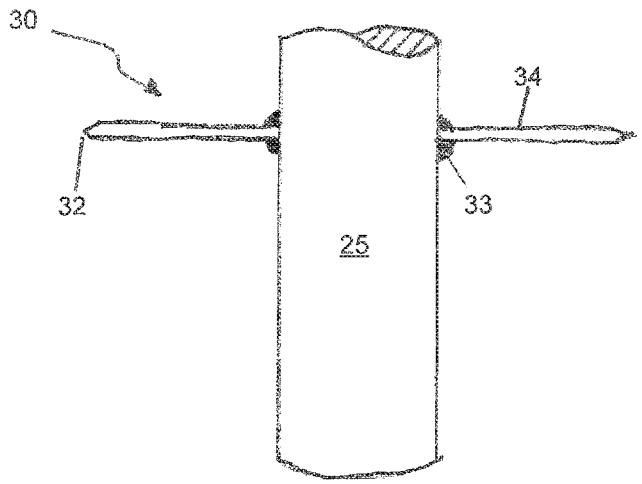
FIG. 2A (Prior Art)
FIGS. 2A, 2B, and 2C are prior art depictions of typical discharge electrode configurations.
Figure 2B:
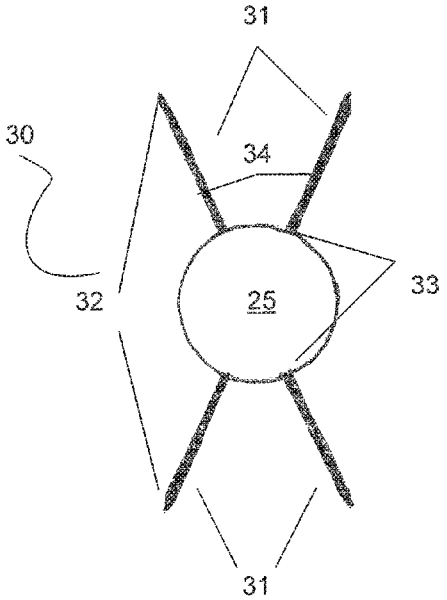
FIG. 2B (Prior Art)
Figure 2C:
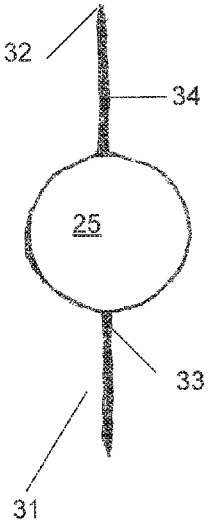
FIG. 2C (Prior Art)
Figure 3:
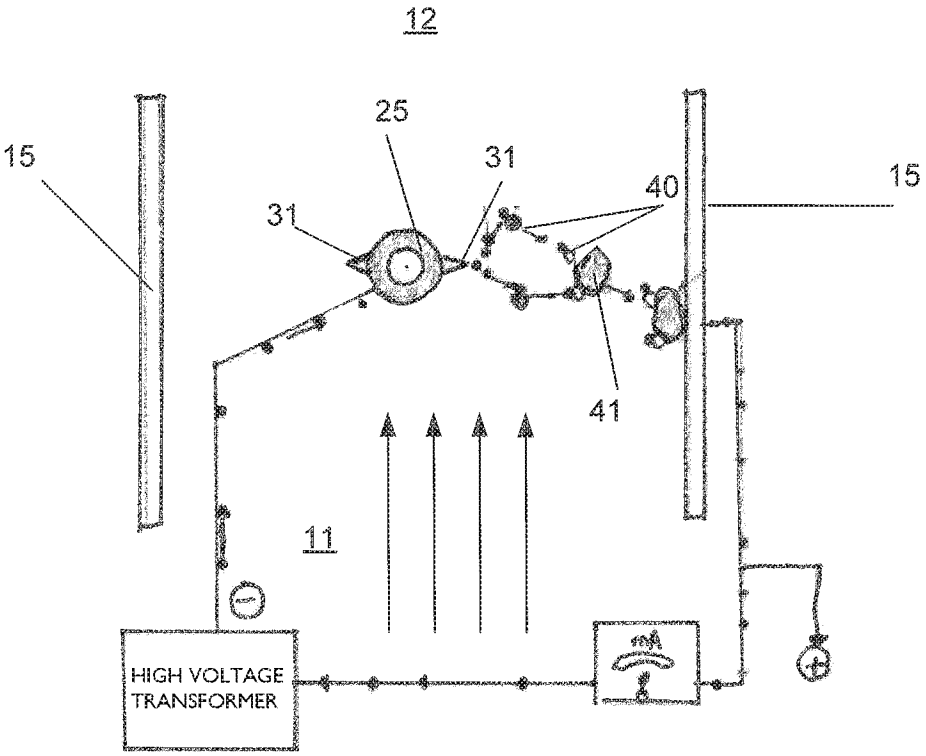
FIGURE 3 (PRIOR ART)
FIG. 3 is a prior art depiction of the typical operation of an ESP.

A hypothetical ESP is used with gases produced from coal and oil boilers. The configuration is assumed to include the use of hanging vertical collecting plates 15 with multiple pipe-and-spike arrays for discharge electrode assemblies 20 arranged in the "V-spike" configuration, as depicted in FIG. 1. The gas pass width between each plate is 12 inches (30.5 cm). The collective plate area assumed to be covered by each tip will be 100 $cm^2$ (15.5 sq. in.) The allowable current density without sparking for this configuration is assumed to be 20 nanoamperes per $cm^2$ (20 $nA/cm^2$). The operating temperature of the flue gas is assumed to be approximately 300° F. Under these conditions, the ESP will produce a current flow of approximate 10 microamperes (μA) through each discharge electrode 30. The desired operating range of the ESP will be between 1 and 10 μA. To produce the necessary voltage drop across the discharge electrode 30 at the lower current flow rate, the spike ends 33 will need to exhibit a total resistance at or below 200 MΩ. At the high current flow rate, the individual spikes 30 will limit excess current by exhibiting a resistance of upwards of 3,000 MΩ.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A discharge electrode for use in an electrostatic precipitator and operating at an operating voltage, the discharge electrode comprising:

a. a base configured to receive electrical current, b. a body formed of a material comprising a non-ohmic material, and c. a discharge tip, where the discharge electrode has a resistance of at least 100 megohms at the operating voltage.

2. The discharge electrode of claim 1, where the non-ohmic material is a semiconductor.

3. The discharge electrode of claim 2, where the material forming the body further comprises a doping impurity.

4. The discharge electrode of claim 3, where the doping impurity is zinc oxide.

5. The discharge electrode of claim 3, where the doping impurity is aluminum nitride.

6. The discharge electrode of claim 1, where the non-ohmic material is a ceramic.

7. The discharge electrode of claim 6, where the ceramic is zinc oxide.

8. The discharge electrode of claim 7, where the ceramic is aluminum nitride.

9. The discharge electrode of claim 7, where the ceramic is dispersed throughout the body.

10. The discharge electrode of claim 7, where the ceramic is a solid chip transecting the body.

11. The discharge electrode of claim 1 where the body is covered by an insulated coating.

12. An electrostatic precipitator comprising:

a. a collecting electrode; and b. a discharge electrode comprising a body and a discharge tip, where a material forming the body comprises a non-ohmic material.

13. The electrostatic precipitator of claim 12, where the non-ohmic material is a semiconductor.

14. The discharge electrode of claim 13, where the material forming the body further comprises a doping impurity.

15. The electrostatic precipitator of claim 12, where the non-ohmic material is a ceramic.

16. The discharge electrode of claim 15, where the ceramic is dispersed throughout the body.

17. The discharge electrode of claim 15, where the ceramic is a solid chip transecting the body.

18. An electrostatic precipitator comprising:

a. a collecting electrode; and b. a discharge electrode comprising a body formed of a material comprising a doping impurity, where the resistance of the body is determined by the concentration of a doping impurity.

19. The electrostatic precipitator of claim 18, where the doping impurity is zinc oxide.

20. The electrostatic precipitator of claim 18, where the doping impurity is aluminum nitride.

* * * * *